US011203058B2

(12) United States Patent
Castle

(10) Patent No.: US 11,203,058 B2
(45) Date of Patent: Dec. 21, 2021

(54) TURBINE BLADE CASTING WITH STRONGBACK CORE

(71) Applicant: Raytheon Technologies Corporation, Farmington, CT (US)

(72) Inventor: Lea Dynnette Castle, Vernon, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 16/953,494

(22) Filed: Nov. 20, 2020

(65) Prior Publication Data

US 2021/0154729 A1 May 27, 2021

Related U.S. Application Data

(60) Provisional application No. 62/939,195, filed on Nov. 22, 2019.

(51) Int. Cl.

| | |
|---|---|
| ***B22C 9/10*** | (2006.01) |
| ***B22C 9/04*** | (2006.01) |
| ***B22C 9/24*** | (2006.01) |
| ***F01D 5/18*** | (2006.01) |

(52) U.S. Cl.

CPC ..... *B22C 9/24* (2013.01); *B22C 9/04* (2013.01); *B22C 9/10* (2013.01); *B22C 9/103* (2013.01); *B22C 9/106* (2013.01); *F01D 5/18* (2013.01); *F05D 2230/21* (2013.01); *F05D 2240/307* (2013.01); *F05D 2260/20* (2013.01)

(58) Field of Classification Search

CPC .... B22C 7/02; B22C 9/04; B22C 9/10; B22C 9/103; B22C 9/24; B22C 21/14; F01D 5/18; F01D 5/187; F01D 5/20

See application file for complete search history.

(56) References Cited

U.S. PATENT DOCUMENTS

| | | | |
|---|---|---|---|
| 4,078,598 | A | 3/1978 | Kelso et al. |
| 5,599,166 | A | 2/1997 | Deptowicz et al. |
| 6,915,840 | B2 | 7/2005 | Devine, II et al. |

(Continued)

FOREIGN PATENT DOCUMENTS

| | | | |
|---|---|---|---|
| AU | 2005201580 | A1 | 1/2006 |
| EP | 2522444 | A1 | 11/2012 |

OTHER PUBLICATIONS

European Search Report dated Feb. 5, 2021 for European Patent Application No. 20209332.4.

*Primary Examiner* — Kevin E Yoon

(74) *Attorney, Agent, or Firm* — Bachman & LaPointe, P.C.

(57) ABSTRACT

A method for casting a blade, the blade with an airfoil having: a tip having at least one of a tip pocket and a tip shelf. Each said at least one of a tip pocket and a tip shelf having a base surface and a sidewall surface. The method includes forming a shell, the forming of the shell including shelling a pattern having at least one ceramic casting core; and casting in the shell, the shell having a first portion formed by the at least one ceramic casting core and a second potion formed by applied shell material. For at least a first tip pocket or tip shelf of the least one of a tip pocket and a tip shelf, the at least one ceramic casting core molds the base surface and the sidewall surface and an adjacent portion of at least one of the pressure side and the suction side spanwise inboard of the base surface.

18 Claims, 9 Drawing Sheets

(56) References Cited

U.S. PATENT DOCUMENTS

| | | | | |
|---|---|---|---|---|
| 7,172,012 | B1 | 2/2007 | Memmen | |
| 7,270,170 | B2 | 9/2007 | Beals et al. | |
| 7,674,093 | B2 * | 3/2010 | Lee | B22C 9/103 416/97 R |
| 7,753,104 | B2 | 7/2010 | Luczak et al. | |
| 2002/0187044 | A1 * | 12/2002 | Lee | F01D 5/18 416/97 R |
| 2010/0116452 | A1 | 5/2010 | Luczak et al. | |
| 2013/0266454 | A1 | 10/2013 | Mongillo, Jr. et al. | |
| 2017/0350255 | A1 * | 12/2017 | Couture | F02C 3/04 |
| 2018/0156045 | A1 * | 6/2018 | Clum | F01D 5/147 |
| 2019/0106989 | A1 | 4/2019 | Nash | |

* cited by examiner

TURBINE BLADE CASTING WITH STRONGBACK CORE

CROSS-REFERENCE TO RELATED APPLICATION

Benefit is claimed of U.S. Patent Application No. 62/939,195, filed Nov. 22, 2019, and entitled "Turbine Blade Casting with Strongback Core", the disclosure of which is incorporated by reference herein in its entirety as if set forth at length.

BACKGROUND

The disclosure relates to manufacture of turbine engine blades. More particularly, the disclosure relates to casting of blades having one or more tip pockets and/or tip shelves.

U.S. Pat. No. 7,270,170 (the '170 patent), Beals et al., Sep. 18, 2007, "Investment casting core methods", discloses a method of casting a turbine engine blade having a tip pocket cast by a ceramic core.

United States Patent Application Publication 20130266454A1 (the '454 publication), Mongillo, Jr., et al., Oct. 10, 2013, "TURBINE AIRFOIL TIP SHELF AND SQUEALER POCKET COOLING", discloses a blade having a tip shelf in addition to the tip pocket. Both have cooling outlets.

United States Patent Application Publication 20190106989A1 (the '989 publication), Nash, Apr. 11, 2019, "GAS TURBINE ENGINE AIRFOIL", discloses a blade airfoil having a swept tip.

Separately, casting with a strongback core is known. See, U.S. Pat. No. 7,753,104 (the '104 patent), Luczak et al., Jul. 13, 2010, "Investment casting cores and methods". The strongback core has a surface that casts an exterior surface of the cast article (e.g., a portion of the pressure side and/or suction side of an airfoil). In the '104 patent, the strongback core is attached to a feedcore to cast a leading edge region spanning the pressure and suction sides.

SUMMARY

One aspect of the disclosure involves a method for casting a blade. The blade comprises: an airfoil having: a proximal end; a tip having at least one of a tip pocket and a tip shelf, each said at least one of a tip pocket and a tip shelf having a base surface and a sidewall surface; a pressure side; and a suction side. The blade further comprises: an attachment root; and a cooling passageway system having one or more inlets on the attachment root and a plurality of outlets. The method comprises: forming a shell, the forming of the shell including shelling a pattern having at least one ceramic casting core; and casting an alloy in the shell. The shell has a first portion formed by the at least one ceramic casting core and a second potion formed by applied shell material. For at least a first tip pocket or tip shelf of the least one of a tip pocket and a tip shelf, the at least one ceramic casting core molds the base surface and the sidewall surface and an adjacent portion of at least one of the pressure side and the suction side spanwise inboard of the base surface.

A further embodiment of any of the foregoing embodiments may additionally and/or alternatively include the adjacent portion being of the pressure side.

A further embodiment of any of the foregoing embodiments may additionally and/or alternatively include the adjacent portion extending for at least 5% of a local span of the airfoil.

A further embodiment of any of the foregoing embodiments may additionally and/or alternatively include the adjacent portion extending for at least 5% of a local streamwise extent of said at least one of the pressure side and the suction side.

A further embodiment of any of the foregoing embodiments may additionally and/or alternatively include the casting being of a nickel-based alloy.

A further embodiment of any of the foregoing embodiments may additionally and/or alternatively include the forming the shell including forming the pattern by: molding the at least one ceramic casting core; and overmolding a pattern material to the at least one casting core.

A further embodiment of any of the foregoing embodiments may additionally and/or alternatively include forming a core assembly of the at least one ceramic casting core prior to the overmolding.

A further embodiment of any of the foregoing embodiments may additionally and/or alternatively include the at least one ceramic casting core including a strongback core and a feedcore. The forming of the core assembly includes mounting the strongback core to the feedcore. The strongback core molds the base surface and the sidewall surface and the adjacent portion.

A further embodiment of any of the foregoing embodiments may additionally and/or alternatively include the pattern material being a wax.

A further embodiment of any of the foregoing embodiments may additionally and/or alternatively include the plurality of outlets including one or more outlets to the at least one of a tip pocket and a tip shelf.

A further embodiment of any of the foregoing embodiments may additionally and/or alternatively include the first tip pocket or tip shelf being a first tip shelf.

A further embodiment of any of the foregoing embodiments may additionally and/or alternatively include the airfoil having a tip sweep providing an angle from the adjacent portion to the first tip shelf base surface of 100° to 130°.

A further embodiment of any of the foregoing embodiments may additionally and/or alternatively include the first tip shelf base surface extending for at least 5% of a local streamwise extent of said at least one of the pressure side and the suction side.

A further embodiment of any of the foregoing embodiments may additionally and/or alternatively include the first tip shelf base surface extending along a region including the leading edge.

A further embodiment of any of the foregoing embodiments may additionally and/or alternatively include the first tip pocket or tip shelf being a first tip pocket.

Another aspect of the disclosure involves a casting core or core assembly for casting a blade. The blade has: an airfoil; an attachment root; and a cooling passageway system having one or more inlets on the attachment root and a plurality of outlets.

The airfoil has: a proximal end; a tip having at least one of a tip pocket and a tip shelf, each said at least one of a tip pocket and a tip shelf having a base surface and a sidewall surface; a pressure side; and a suction side. For at least a first tip pocket or tip shelf of the least one of a tip pocket and a tip shelf, the casting core or core assembly is shaped and positioned to mold the base surface and the sidewall surface and an adjacent portion of at least one of the pressure side and the suction side spanwise inboard of the base surface.

A further embodiment of any of the foregoing embodiments may additionally and/or alternatively include the airfoil has a tip sweep providing an angle from the adjacent portion to the first tip shelf base surface of 100° to 140° or 100° to 130°.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
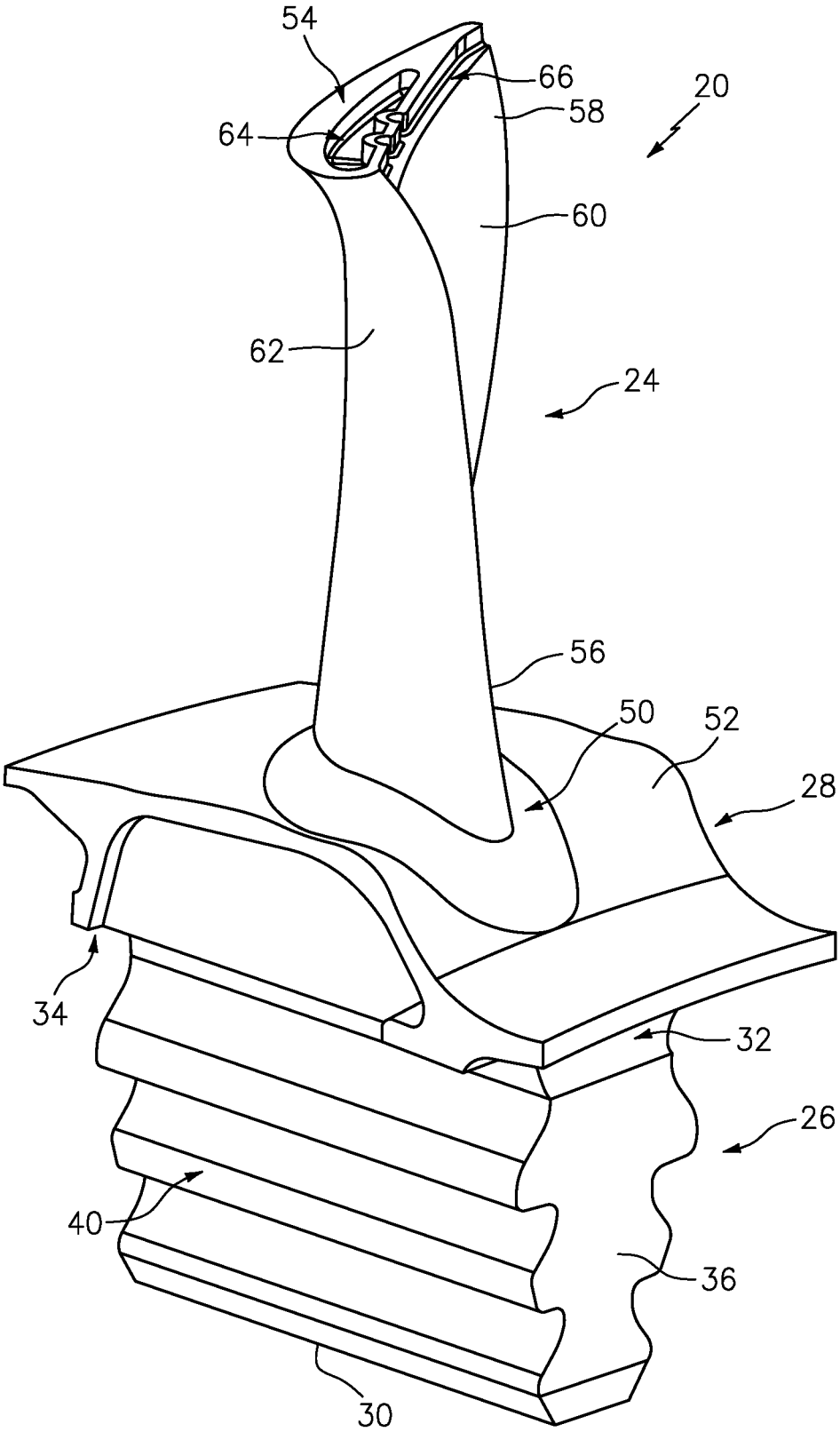
FIG. 1 is a first view of a turbine engine blade.
Figure 2:
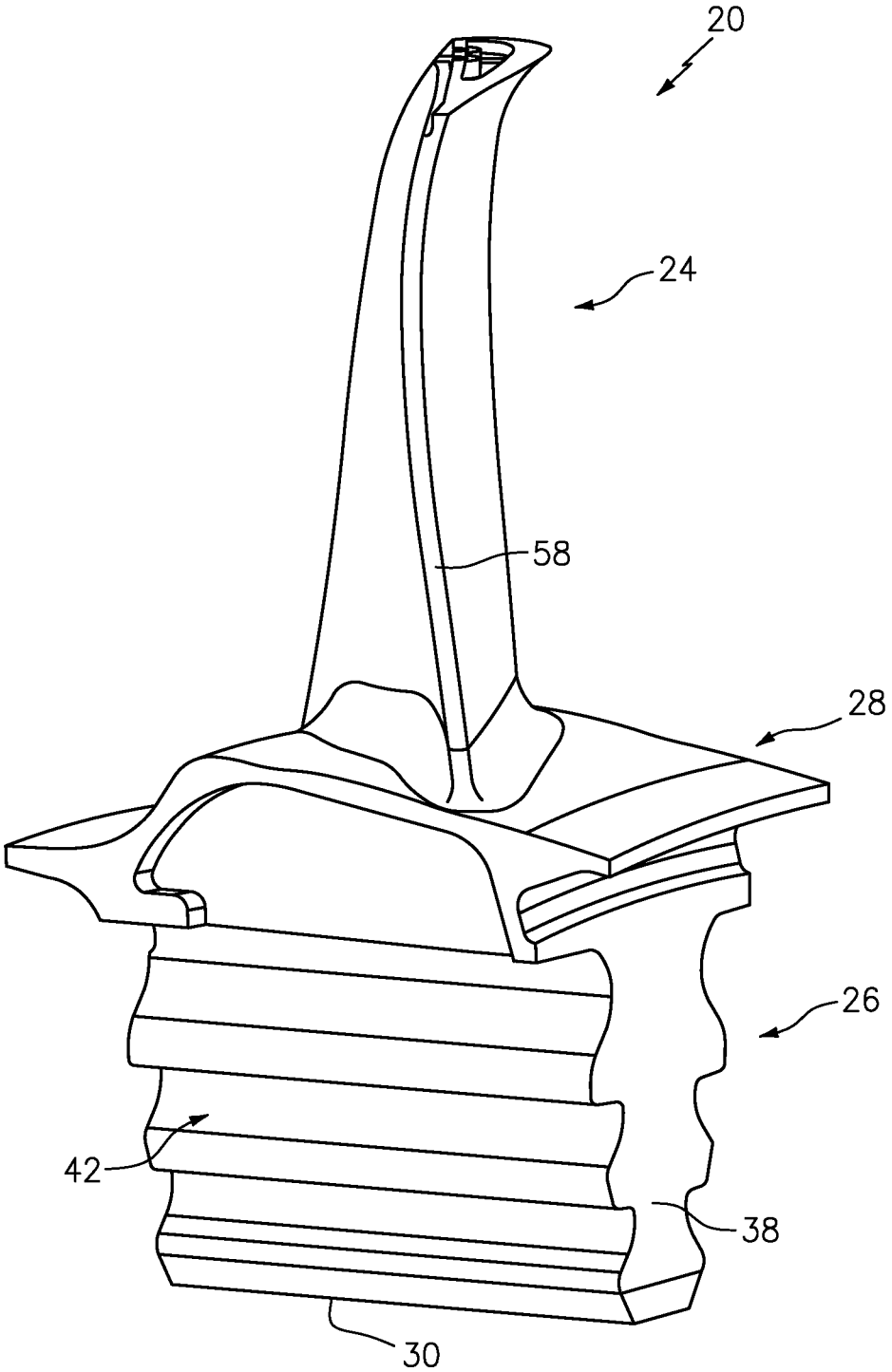
FIG. 2 is a second view of the turbine engine blade.

FIG. 1 shows a blade 20 comprising a metallic substrate (e.g., nickel-based superalloy) and optionally one or more coatings (not shown—e.g., ceramic thermal barrier coatings environmental barrier coatings, and the like). The blade and substrate have an airfoil 24, an attachment root 26, and optionally a platform 28 at a blade-root junction. The attachment root 26 (e.g., firtree or dovetail) has: an inner diameter (ID) end 30 (relative to the centerline of the engine and disk (not shown) in which the blade mounts; an outer diameter end 32 at an underside 34 of the platform; a forward end 36; and aft end 38 (FIG. 2); a first lateral side 40 (FIG. 1); and a second lateral side 42 (FIG. 2).

Figure 3:
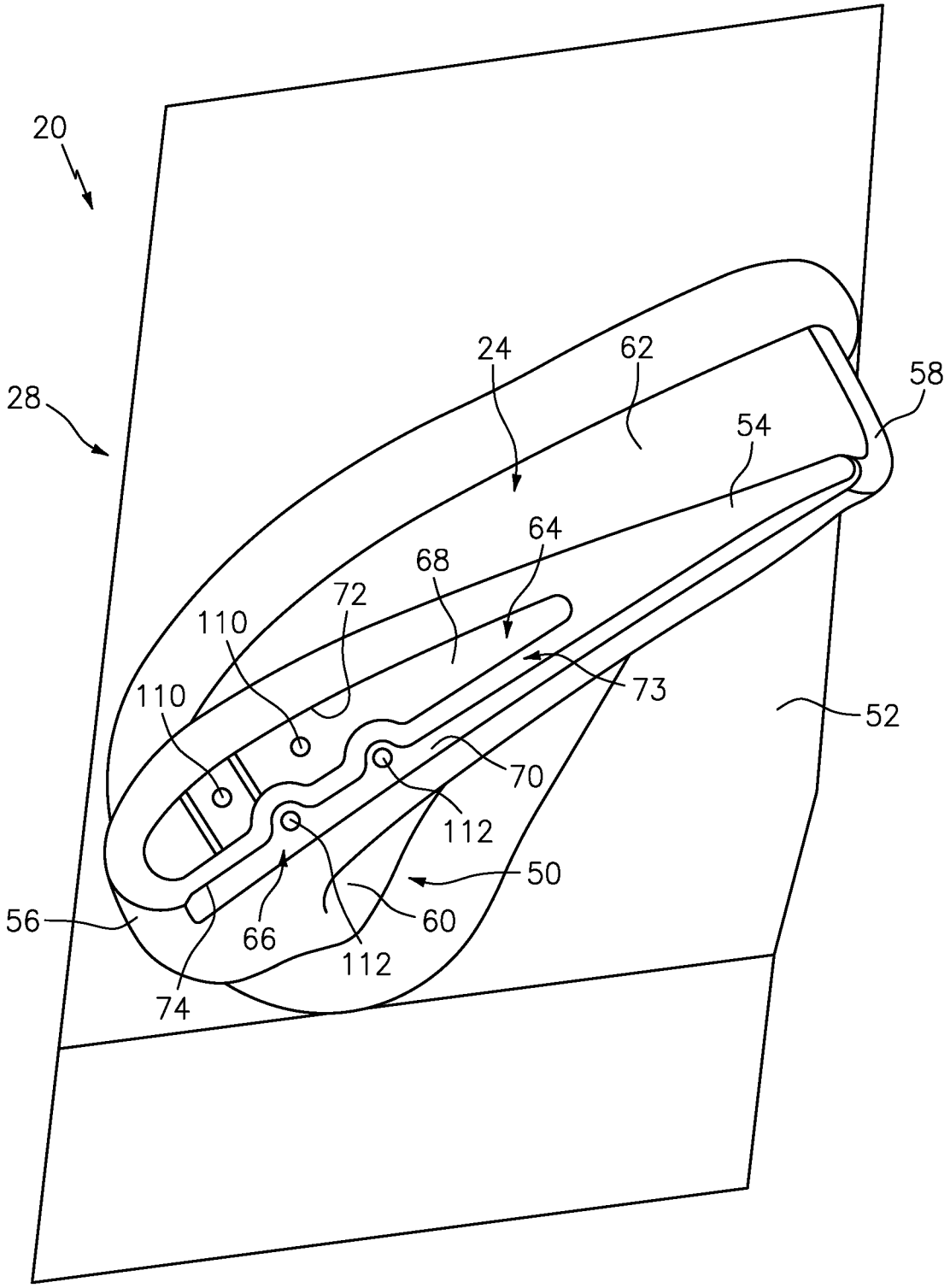
FIG. 3 is a tip view of the turbine engine blade.
Figure 3A:
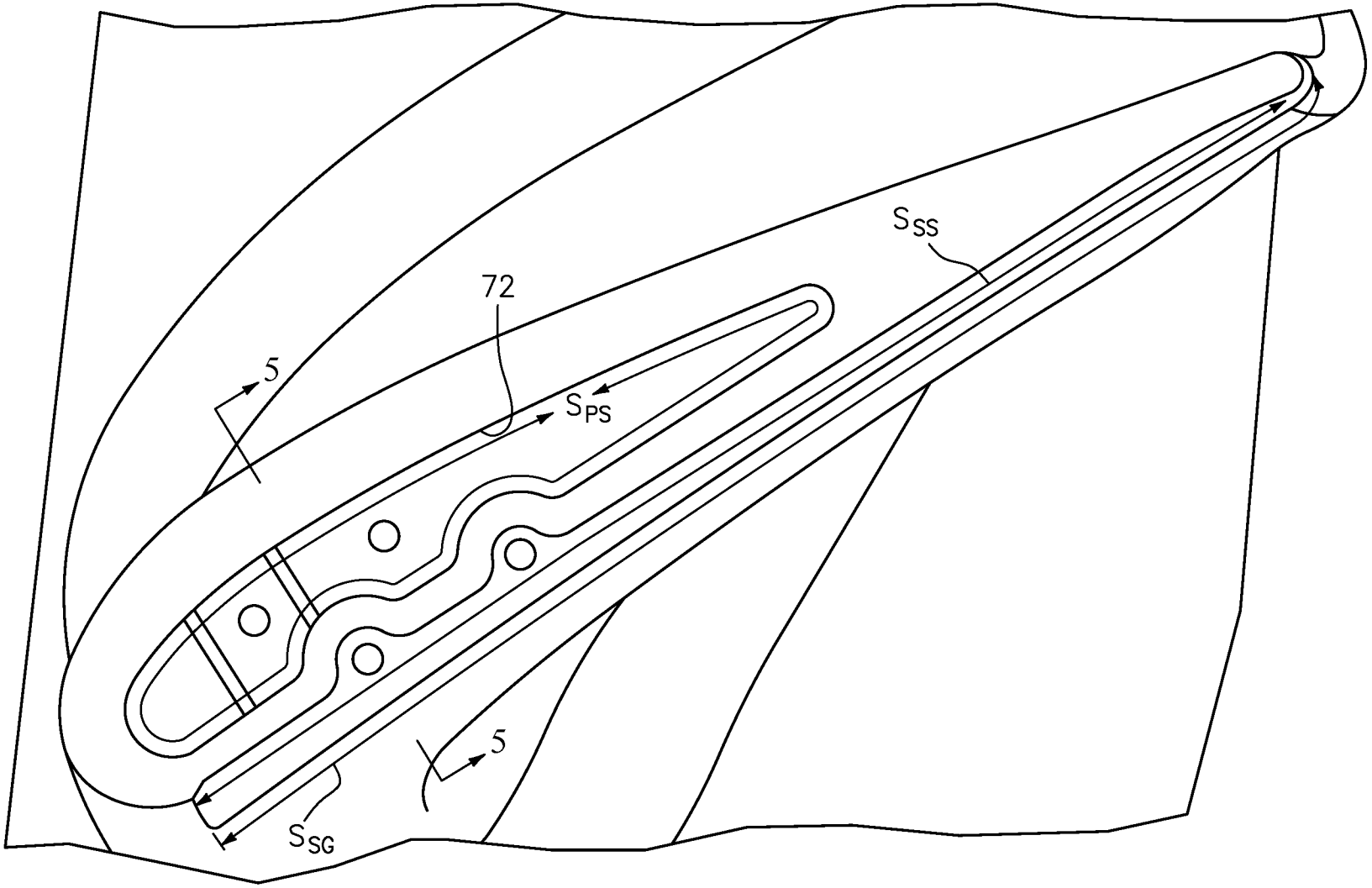
FIG. 3A is an enlarged view of the turbine engine blade tip of FIG. 3.

The airfoil 24 (FIG. 3) has: an inner diameter (ID) proximal end 50 at the platform outer diameter (OD) gaspath surface 52; a tip 54; a leading edge 56; a trailing edge 58; a pressure side 60; and a suction side 62.

The tip 54 (FIG. 3) has at least one of a tip pocket 64 and a tip shelf 66. Each tip pocket has a base surface 68 and each tip shelf has a base surface 70. Each tip pocket has a sidewall surface 72 (an interior/inner surface) and each tip shelf has a sidewall surface 74 (an interior/inner surface). Where a tip shelf is adjacent a tip pocket, a portion of the tip pocket sidewall surface 72 forms an inner surface of a wall structure 73 (FIG. 3) separating the tip shelf from the tip pocket and at least a portion of the tip shelf sidewall surface 74 forms an outer surface of the wall structure 73.

Figure 4:
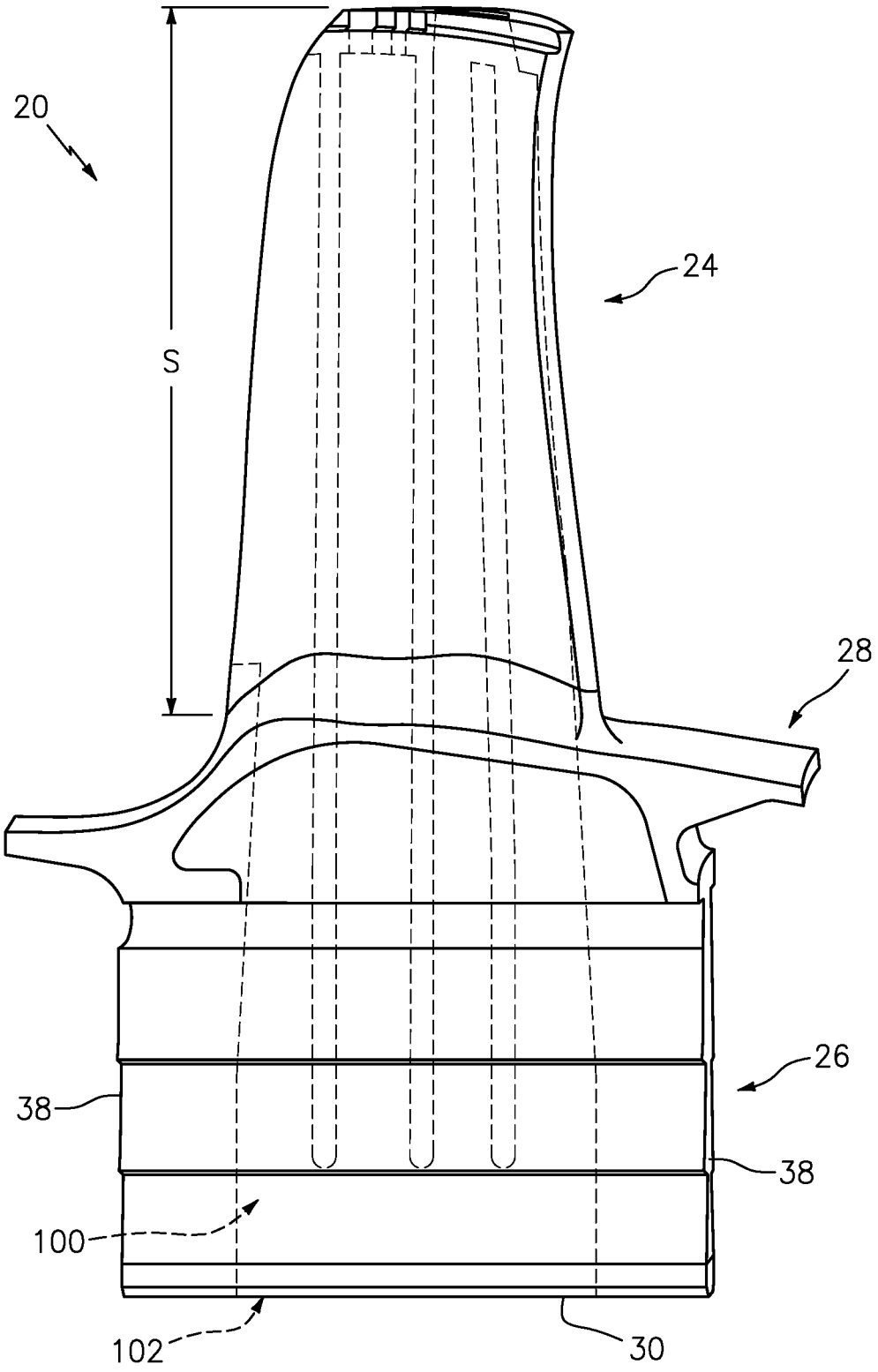
FIG. 4 is an x-ray view of the turbine engine blade.

The blade and casting further comprise a cooling passageway system 100 (FIG. 4) having one or more inlets 102 on the attachment root and a plurality of outlets. In typical blades, the outlets may include outlets along the trailing edge, airfoil pressure side, suction side, platform gaspath surface, and tip pocket and/or tip shelf.

The non-limiting example blade has both a single tip pocket 64 and a single tip shelf 66, although other variations are possible. Similarly, the example blade has outlets 110, 112 (FIG. 3) along both the tip pocket and tip shelf, although other variations are possible. The exemplary tip pocket outlets 110 are generally centrally located along the base surface 68. The exemplary shelf outlets 112 are along bosses protruding from the base surface 70 and sidewall surface 74. The example tip pocket 64 is fully surrounded by its sidewall surface 72, although tip pockets with outlet gaps in the sidewall are possible.

Figure 5:
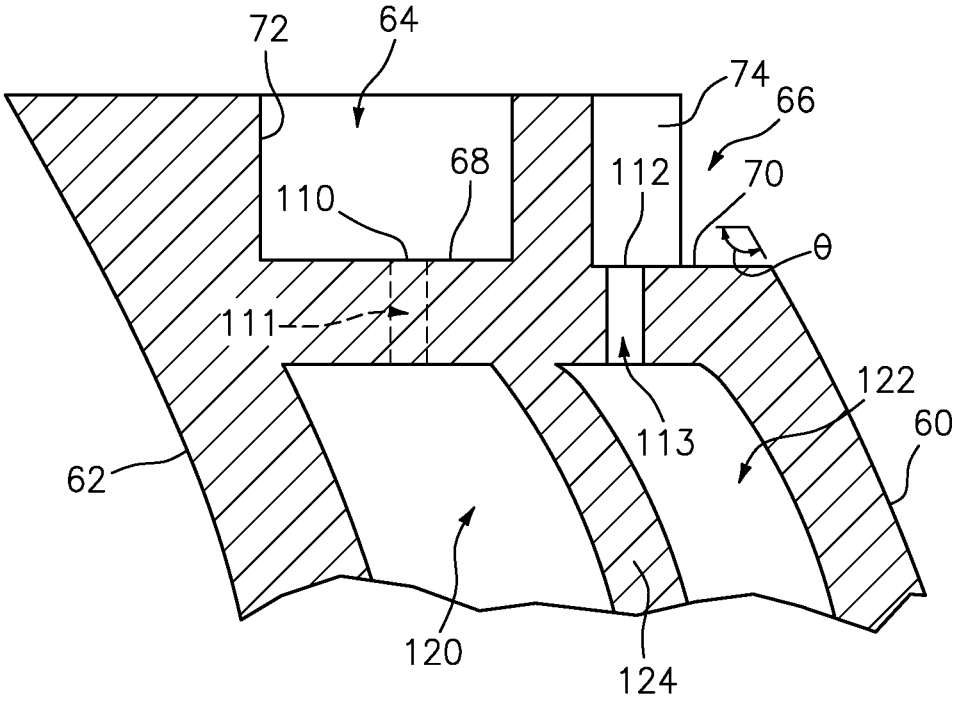
FIG. 5. is a partial sectional view of the blade of FIG. 1, taken along line 5-5 in FIG. 3A.

FIG. 5 shows the outlets 110 and 112 at terminal/downstream ends of outlet/discharge passageways 111 and 113, respectively, from feed passageways 120 and 122 of the cooling passageway system 100. Additional passageways or legs may be distributed streamwise/chordwise within the airfoil. In this particular example, the two passageways 120 and 122 are spaced apart from each other between the pressure side and suction side via a wall section 124. However, alternative embodiments may have the outlet/discharge passageways 111 and 113 fed in common from a single passageway leg or section.

The perimeter of the tip pocket 64 is the perimeter span $S_{PS}$ of the sidewall surface 72 plus the span across any gap. The perimeter of the tip shelf 66 is similarly the perimeter span $S_{SS}$ of its sidewall surface plus the perimeter span $S_{SG}$ of the gap. The tip pocket gap span, if any, will typically be a small fraction of the tip pocket perimeter (e.g., 5% or less). The tip shelf gap span $S_{SG}$ will typically be a substantial fraction (e.g., at least 40% or at least 60% of the tip shelf perimeter). As is discussed further below, a strongback core is used to cast the tip pocket 64 and/or tip shelf 66 on the one hand and an adjacent portion of the airfoil surface (pressure side 60 and/or suction side 62). Depending on implementation, this adjacent portion may span the leading edge 56 or trailing edge 58 or may be isolated to one or both of the pressure side and suction side.

Figure 6:
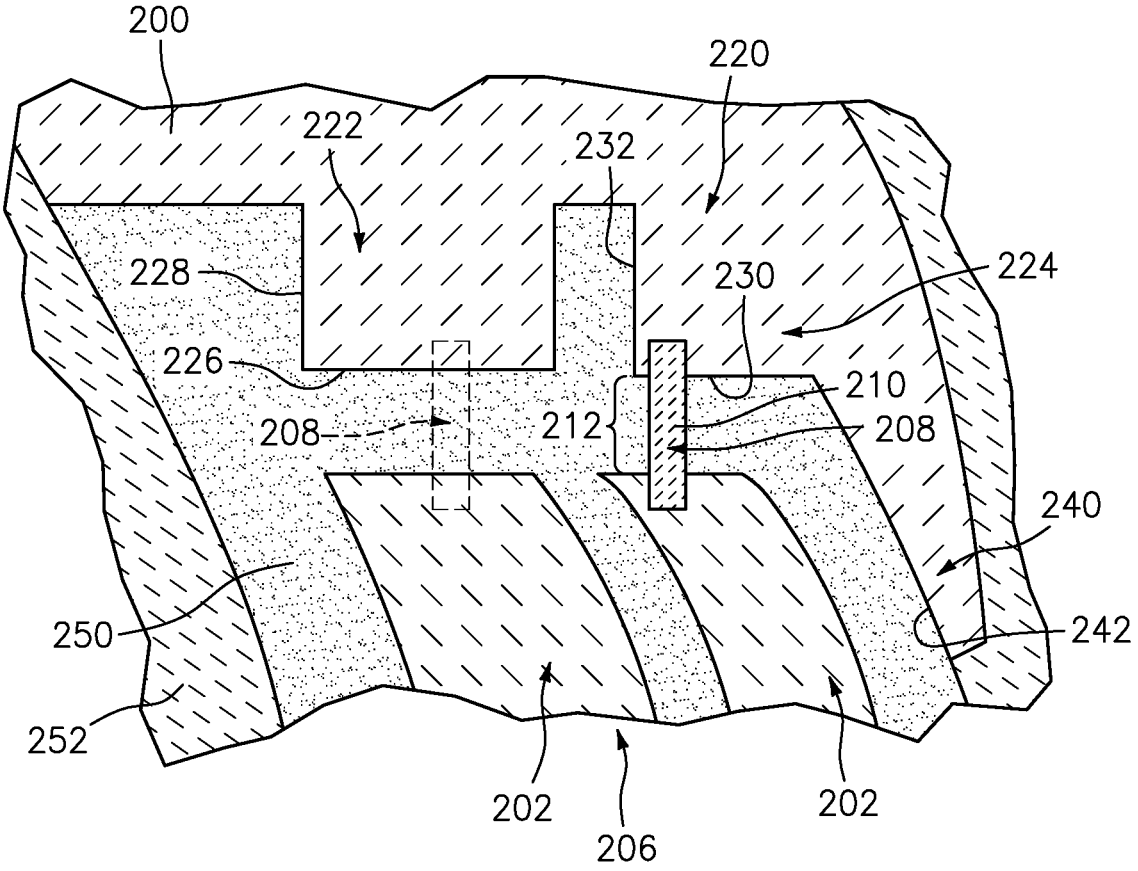
FIG. 6 is a cross-sectional view of a shelled pattern including a casting core assembly for casting the blade substrate.

As is discussed below, the blade substrate is cast using a strongback core 200 (FIG. 6). In an exemplary process of manufacture, the strongback core 200 (FIG. 6) is initially separately formed from a feedcore 202 (e.g., separately molded as two separate ceramic pieces such as silica and/or alumina). The strongback core is then assembled to the feedcore to form a core assembly 206. Alternatively, the core assembly 206 may also be formed as a unitary piece (e.g. a single molding). The strongback core 200 may alternatively be formed by overmolding the feedcore 202 to create external features of the blade substrate. In areas of the core assembly that are not covered by the pattern material 250 (e.g., protruding from the overmolded pattern material) may become embedded in the shell as discussed below. Areas of the core assembly covered by the pattern material will generally cast corresponding areas of the raw casting. For the strongback core, such areas of the casting include a tip pocket and/or tip shelf and a portion of an airfoil pressure side or suction side.

Figure 7:
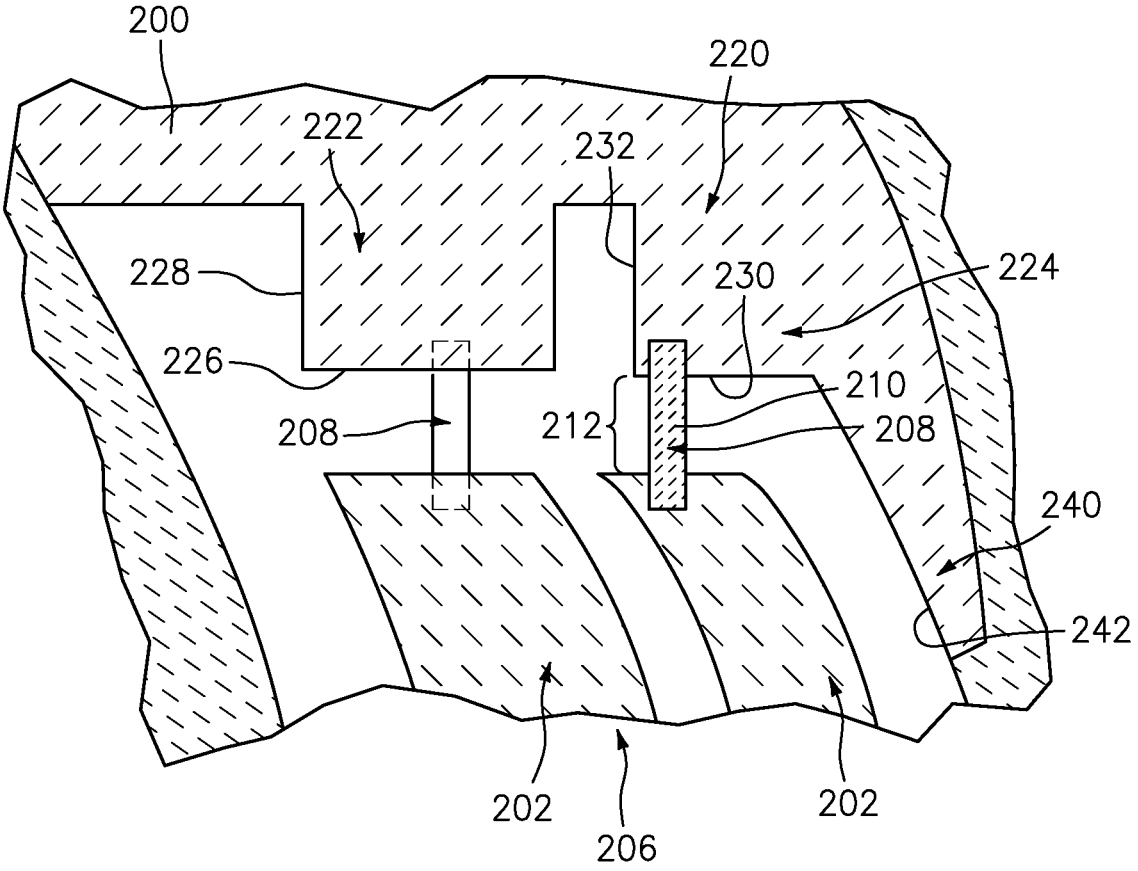
FIG. 7 is a cross-sectional view of the shell after dewaxing.
Figure 8:
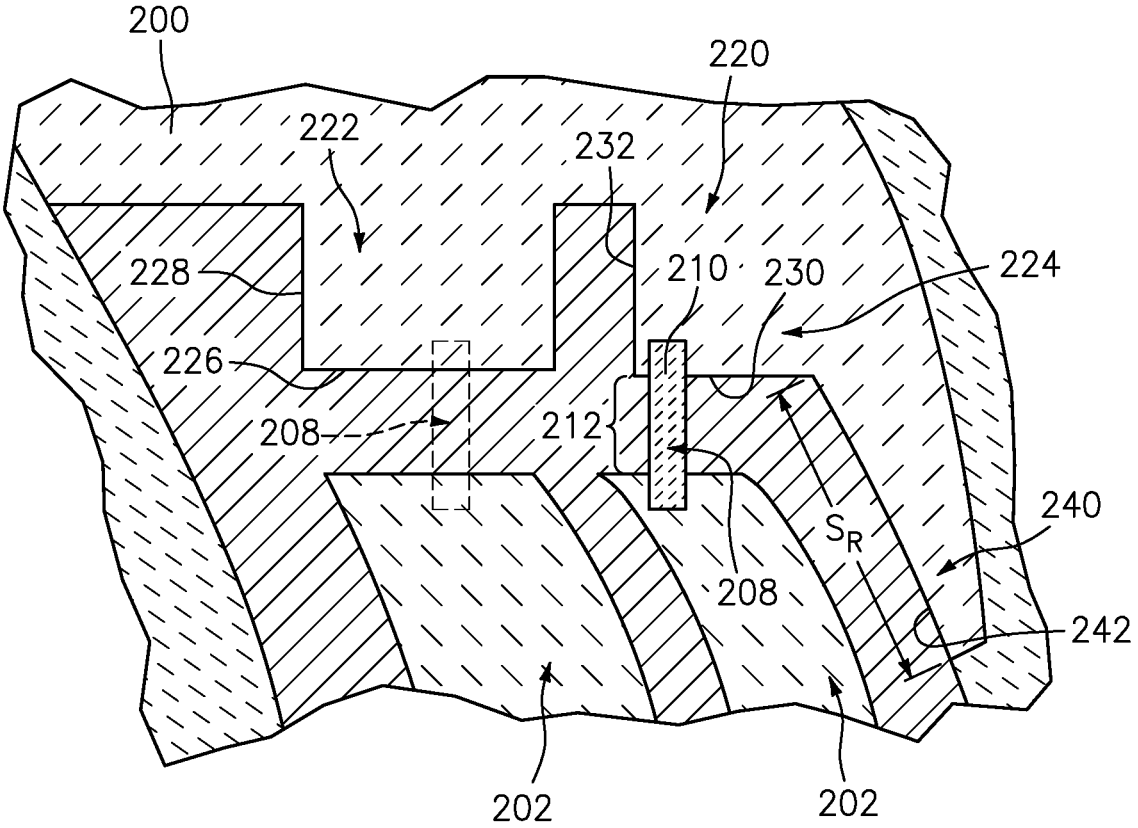
FIG. 8 is a view of the shell after casting the blade substrate.

FIG. 6 is a partial cross-sectional view of a shelled pattern including a casting core assembly 206, sacrificial pattern material 250 (e.g., wax or leachable polymer), and a shell 252 (e.g., ceramic stucco). The pattern material 250 is molded over all or a portion of the core assembly and then shelled with ceramic stucco slurry to form the shell 252. The strongback core 200 also serves as an anchor between the feedcore 206 and the shell 252. The wax may be removed and the shell fired to harden, leaving a cavity (FIG. 7) corresponding to the casting. The substrate alloy is then cast in the shell over the core assembly (FIG. 8). Thereafter deshelling (e.g., mechanical breaking) and decoring (e.g., acid and/or alkali leaching and/or thermo-oxidative process) may leave a raw casting. The raw casting may be finish machined, coated and the like.

In one example of assembly of the core assembly 206, yet separately-formed rods 208 (e.g., molded ceramic such as silica and/or alumina) connect the strongback core to the feedcore. The rods may have respective end portions received in pockets (e.g., circular drilled bores or similar molded pockets) of the feedcore and strongback core. The rods may each have an exposed central portion 210 spanning a gap 212 between the strongback core and feedcore. The central portions 220 mold respective outlet passageways 111, 113 with the gap molding a tip end wall forming the base of the tip pocket and/or shelf. The strongback core 200 has a section 220 for casting the tip pocket and tip shelf. The section 220 has a first protruding portion 222 for casting the tip pocket and a second protruding portion 224 for casting the tip shelf. The first portion 222 has an end surface 226 for casting the tip pocket base surface 68 and a lateral surface 228 for casting the tip pocket sidewall surface 72. Similarly, the second portion 224 has an end surface 230 for casting the tip shelf base surface 70 and a lateral surface 232 for casting the tip shelf sidewall surface 74.

The strongback core 200 has a second section 240 extending rootward from the first section and having a surface 242 positioned to cast a portion of at least one of the airfoil pressure side 60 and suction side 62 (in this case pressure side 60). The exemplary airfoil has a swept tip with sweep away from the pressure side. FIG. 5 shows an angle θ between the pressure side and the tip. In an unswept, uncanted, and untapered airfoil, θ would be 90°. Taper would cause only a small deviation. The sweep, however, produces exemplary θ of 100° to 140° or 100° to 130°.

The surface 242 may extend for a substantial fraction of the gap span $S_{SG}$ (e.g., at least 50% and even more than 100%. This span of the surface 242 may extend for at least 5% or at least 20% of a local streamwise extent of said at least one of the pressure side and the suction side. Additionally, the surface 242 may extend spanwise along the airfoil (root-to-tip or radial direction) by a span $S_R$ (FIG. 8) which is a non-trivial fraction of the airfoil span S of FIG. 4. For example, at one or more streamwise locations along the section 240 and surface 242 $S_R$ may extend for at least 2% or at least 5% of the span S at that location. $S_R$ may extend up to the full span in embodiments where the strongback core extends all the way to the platform. Alternative upper limits with either of the 2% or 5% lower limits could be 20%, 30%, or 50%.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

What is claimed is:

1. A method for casting a blade, the blade comprising:
an airfoil having:
a proximal end;
a tip having at least one of a tip pocket and a tip shelf, each said at least one of a tip pocket and a tip shelf having a base surface and a sidewall surface;
a pressure side; and
a suction side;
an attachment root; and
a cooling passageway system having one or more inlets on the attachment root and a plurality of outlets,
the method comprising:
forming a shell, the forming of the shell including shelling a pattern having at least one ceramic casting core; and
casting an alloy in the shell, the shell having a first portion formed by the at least one ceramic casting core and a second potion formed by applied shell material,
wherein:
for at least a first tip pocket or tip shelf of the least one of a tip pocket and a tip shelf, the at least one ceramic casting core molds the base surface and the sidewall surface and an adjacent portion of at least one of the pressure side and the suction side spanwise inboard of the base surface.

2. The method of claim 1 wherein:
the adjacent portion is of the pressure side.

3. The method of claim 1 wherein:
the adjacent portion extends for at least 5% of a local span of the airfoil.

4. The method of claim 1 wherein:
the adjacent portion extends for at least 5% of a local streamwise extent of said at least one of the pressure side and the suction side.

5. The method of claim 1 wherein:
the casting is of a nickel-based alloy.

6. The method of claim 1 wherein the forming the shell includes forming the pattern by:
molding the at least one ceramic casting core; and
overmolding a pattern material to the at least one casting core.

7. The method of claim 6 further comprising:
forming a core assembly of the at least one ceramic casting core prior to the overmolding.

8. The method of claim 7 wherein:
the at least one ceramic casting core includes a strongback core and a feedcore;
the forming of the core assembly includes mounting the strongback core to the feedcore; and
the strongback core molds the base surface and the sidewall surface and the adjacent portion.

9. The method of claim 6 wherein:
the pattern material is a wax.

10. The method of claim 1 wherein:
the plurality of outlets include one or more outlets to the at least one of a tip pocket and a tip shelf.

11. The method of claim 1 wherein:
the first tip pocket or tip shelf is a first tip shelf.

12. The method of claim 11 wherein:
the airfoil has a tip sweep providing an angle from the adjacent portion to the first tip shelf base surface of 100° to 130°.

13. The method of claim 11 wherein:
the first tip shelf base surface extends for at least 5% of a local streamwise extent of said at least one of the pressure side and the suction side.

14. The method of claim 11 wherein:
the first tip shelf base surface extends along a region including the leading edge.

15. The method of claim 1 wherein:
the first tip pocket or tip shelf is a first tip pocket.

16. A casting core or core assembly for casting a blade, the blade comprising:
an airfoil having:
a proximal end;

a tip having at least one of a tip pocket and a tip shelf, each said at least one of a tip pocket and a tip shelf having a base surface and a sidewall surface;

a pressure side; and a suction side;

an attachment root; and a cooling passageway system having one or more inlets on the attachment root and a plurality of outlets, wherein:

for at least a first tip pocket or tip shelf of the least one of a tip pocket and a tip shelf, the casting core or core assembly is shaped and positioned to mold the base surface and the sidewall surface and an adjacent portion of at least one of the pressure side and the suction side spanwise inboard of the base surface.

17. The casting core or core assembly of claim 16 wherein:

the airfoil has a tip sweep providing an angle from the adjacent portion to the first tip shelf base surface of 100° to 140°.

18. The casting core or core assembly of claim 16 wherein:

the airfoil has a tip sweep providing an angle from the adjacent portion to the first tip shelf base surface of 100° to 130°.

* * * * *